US006223383B1

(12) United States Patent
VanPutten

(10) Patent No.: US 6,223,383 B1
(45) Date of Patent: May 1, 2001

(54) CLEANING AND POLISHING PAD FOR FLOORS AND THE LIKE

(76) Inventor: Theron A. VanPutten, 7645 Timber Bluff SE., Ada, MI (US) 49301

( * ) Notice: Subject to any disclaimer, the term of this patent is extended or adjusted under 35 U.S.C. 154(b) by 0 days.

(21) Appl. No.: 09/258,175

(22) Filed: Feb. 25, 1999

Related U.S. Application Data

(60) Provisional application No. 60/076,271, filed on Feb. 27, 1998.

(51) Int. Cl.[7] ..... A47L 11/40; A47L 13/16

(52) U.S. Cl. ..... 15/230; 15/230.16

(58) Field of Search ..... 15/230, 230.12–230.19; 451/526, 533, 536, 921

(56) References Cited

U.S. PATENT DOCUMENTS

| | | | | |
|---|---|---|---|---|
| 1,797,040 | * | 3/1931 | Bartling | 15/230.16 |
| 1,799,808 | * | 4/1931 | Bartling | 15/230.16 |
| 1,926,812 | * | 9/1933 | McGrady et al. | 15/230.15 |
| 2,476,537 | * | 7/1949 | Erickson | 15/230.16 X |
| 2,546,102 | * | 3/1951 | Le Rette | 15/230.15 |
| 3,122,768 | * | 3/1964 | Beumkes | 15/223 X |
| 3,204,277 | * | 9/1965 | Visman et al. | 15/223 X |
| 3,417,420 | * | 12/1968 | Rock | 15/230.16 |
| 3,512,204 | * | 5/1970 | Jagiel | 15/230.16 |
| 3,981,106 | * | 9/1976 | Gallo | 15/230 X |
| 4,482,391 | * | 11/1984 | Pettingell et al. | 15/230.14 |
| 4,709,439 | * | 12/1987 | Warren et al. | 15/230.16 |
| 4,739,534 | * | 4/1988 | Wilson | 15/230.16 |
| 4,967,440 | * | 11/1990 | Belanger | 15/230.14 |
| 5,533,222 | * | 7/1996 | Lelkes et al. | 15/230 X |

FOREIGN PATENT DOCUMENTS

| | | | | |
|---|---|---|---|---|
| 63-93653 | * | 4/1988 | (JP) | 15/230.14 |

* cited by examiner

*Primary Examiner*—Mark Spisich
(74) *Attorney, Agent, or Firm*—Price, Heneveld, Cooper, DeWitt & Litton

(57) ABSTRACT

A pad for a rotary-type floor cleaning and/or polishing machine which comprises a generally disc-like member of hair or fiber mat, etc., which has a perimetral (i.e., circumferential) edge with a series of recesses extending generally inwardly and away from the nominal outer circumference of the disc-like member, toward the center part of the latter, to form a plurality of sequentially arranged, outwardly projecting portions between such recesses which are disposed adjacent one another around the circumference of the disc-like member. In various possible embodiments, these outwardly projecting portions define an undulating or scalloped outer periphery, and such portions are preferably of rounded configuration, formed by arcuate or at least partially circular edges which also define the aforementioned recesses. Further, in preferred embodiments, such projecting portions are disposed directly and closely adjacent one another around the entire outer periphery or perimeter of the disc-like pad.

1 Claim, 1 Drawing Sheet

CLEANING AND POLISHING PAD FOR FLOORS AND THE LIKE

CROSS-REFERENCE TO RELATED APPLICATION

This application claims priority under 35 U.S.C. §119(e) on U.S. Provisional Application No. 60/076,271 entitled CLEANING AND POLISHING PAD FOR FLOORS AND THE LIKE, filed Feb. 27, 1998, by Theron A. VanPutten, the entire disclosure of which is incorporated herein by reference.

BACKGROUND OF THE INVENTION

This invention relates to the cleaning and polishing of floors by rotary-type motor-driven machines of the general type which have long been in use, in particular the commercial-type devices commonly used in public places to clean and polish hard-surfaced floors.

Floor-cleaning and polishing machines of the type noted above utilize rotary, motor-driven pads of disc-like configuration as the physical element which is actually placed in contact with the floor surfaces to clean or polish them, using various liquid or other chemical preparations as the cleaning or polishing agent. These rotary "pads" are made from various compositions, including for example, various natural hair substances (in particular, hog hair), synthetic fibers such as polyester and nylon, etc., which are bonded together by various resins or the like to form flat, disc-shaped matted members of various thicknesses and varying degrees of stiffness and abrasiveness. The particular type of pad selected from this variety depends upon the particular task required, i.e., the type of floor involved, surface condition (degree of roughness, etc.), the issue of whether cleaning or polishing is desired, the type of dirt, stain, or discoloration to be removed, etc.

The selected pad is mounted on a base plate or pad holder located at the bottom of the cleaning machine, which is coupled to the drive motor for rotation. One example of a satisfactory such pad holder comprises a circular steel plate with a resilient foam adhered to it and a stiff or rigid plastic or other such disc glued or otherwise secured to the outside surface of the foam. The face or lowermost surface of the plastic disc includes means for securing the cleaning/polishing pad to it, one such means being a relatively large number of small hook-like protrusions similar to those used in the commercial connector apparatus sold under the trademark "Velcro." With such structure, the fibrous pad is readily and securely attached to the pad holder by simply pressing the two together, without having to use any mechanical fasteners, etc. Further, the pad is readily removable from such a holder by merely pulling it off the pad holder and thus disengaging the small hooks from the fibers of the pad.

It is a generally recognized fact that larger diameter pads do not conform to floor surface irregularities as well as smaller pads do. This is demonstrated by the fact that practically all commercially available floor machines are designed to cover a width of more than twenty to twenty eight inches, employ a pair of smaller adjacent pads rather than a single large pad, and many times even machines designed for smaller widths employ two or more smaller pads rather than one larger one. Since each separate pad requires a separate drive motor and related structure, apparatus, etc., it is more expensive to manufacture machines which use more than one pad even though the performance may be better. Consequently, compromises are made according to individual preferences and convictions, but as a general rule machines with smaller pads produce better results than machines with larger ones. Improved results are obtained from the smaller pads because their smaller diameter and corresponding sharper peripheral curvature enables them to better conform to floor surface irregularities, and to better access impressions or recesses in the floor surface, particularly when their rotational plane is in effect tilted by raising or lowering the handle of the machine on which they are mounted, a practice referred to in the industry as "heeling." Furthermore, the torsional resistance or drag felt by the machine operator is reduced when smaller pads are used, especially if they are counter-related, thereby reducing the required effort and decreasing operator fatigue.

BRIEF SUMMARY OF THE INVENTION

The present invention is based on the novel recognition that both better cleaning and polishing can be achieved with pads of virtually any size by providing pads whose outer periphery is more flexible than would conventionally be true for a given pad composition, and also on the recognition that providing an increased amount of peripheral edge on the pad contributes significantly to such improved results. Accordingly, the present invention achieves significantly improved cleaning and polishing results for any given pad size in a completely novel manner; i.e., by changing the peripheral configuration of the polishing/cleaning pad, rather than by simply making it smaller and employing a larger number of such pads and their related drive motors, etc. Briefly stated, the edge configuration of the pad contemplated by the invention has a periodically notched or recessed shape, preferably of a scalloped or undulating character. The most preferred such shape presently contemplated has a series of partially circular edge projections formed by a succession of adjacent arcuate recesses or reliefs provided as a continuing sequence around the diametral edge of the pad.

Accordingly, the present invention provides a pad for a rotary-type floor cleaning and/or polishing machine which comprises a generally disc-like member having a perimetral (i.e., circumferential) edge with a series of recesses extending generally inwardly and away from the nominal outer circumference of the disc-like member, toward the center part of the latter, to form a plurality of sequentially arranged, outwardly projecting portions between such recesses which are disposed adjacent one another around the circumference of the disc-like member. In various possible embodiments, these outwardly projecting portions define an undulating or scalloped outer periphery, and such portions are preferably of rounded configuration, formed by arcuate or at least partially circular edges defining the aforementioned recesses. Further, in preferred embodiments, such projecting portions are disposed closely adjacent one another around the entire outer periphery or perimeter of the disc-like pad.

By using the type of edge configuration just noted, greater operational flexibility is provided for practically any type of conventionally known pad, including hog hair and./or synthetic fiber mat-type pads as are commonly used, since each such successive segment provides an edge which is somewhat analogous to that of a very small-diameter cleaning/polishing pad; further, the continuously segmented or undulated perimeter provides a continuing sequence of such small-diameter pad analogs, each of which regularly and sequentially contacts the floor to closely follow surface irregularities, including both raised and lowered areas (high spots and low spots).

DESCRIPTION OF PREFERRED EMBODIMENTS

As generally illustrated above, the basic construction of a cleaning/polishing pad for rotary floor machines in accordance with the invention is structurally the same as pads already commercially known and used, e.g., a basically disc-shaped mat made up of hair or other fiber which is secured together by a resin or other such binder to form a coherent member, which is at least somewhat flexible and which may have varying degrees of surface abrasiveness, etc. The present invention may be considered to be a novel modification for such known types of pads, which provides previously unappreciated advantages and improvements in performance.

As indicated above, the modified configuration for a floor pad in accordance with the invention incorporates an outer periphery of generally undulating configuration, preferably comprising a series of mutually adjacent rounded projections extending around the perimeter, formed by corresponding recesses or cutout portions.

Figure 1:
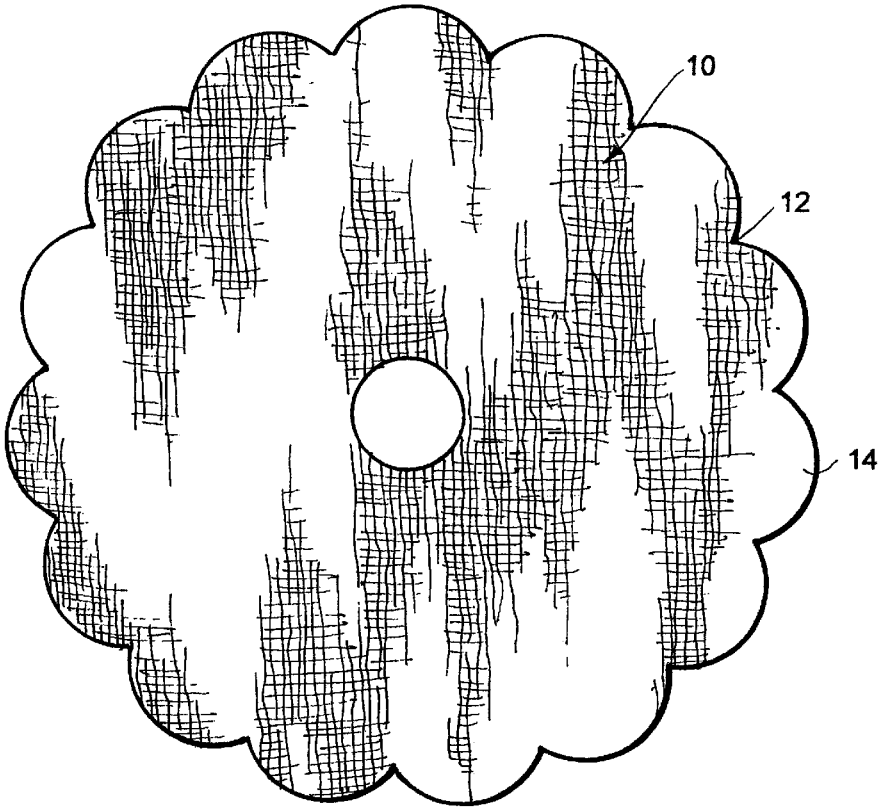
FIG. 1 is a plan view showing a preferred pad configuration in accordance with the invention.
Figure 2:
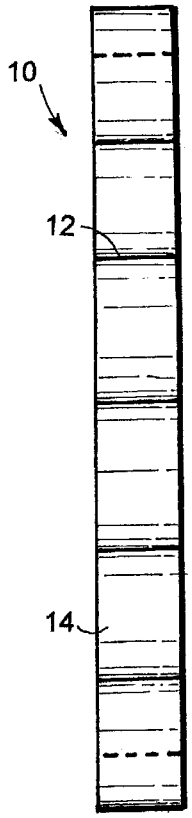
FIG. 2 is a side elevational view of the pad shown in FIG. 1.
Figure 3:
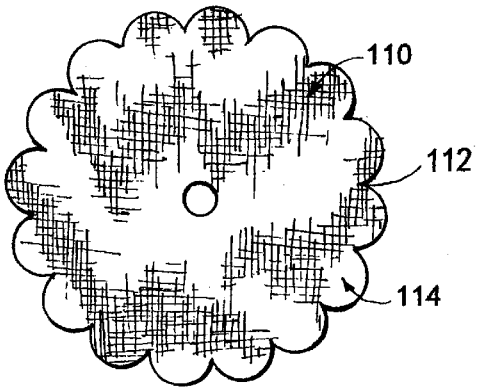
FIG. 3 is a plan view similar to FIG. 1 but on a reduced scale and showing another embodiment of a pad in accordance herewith.
Figure 4:
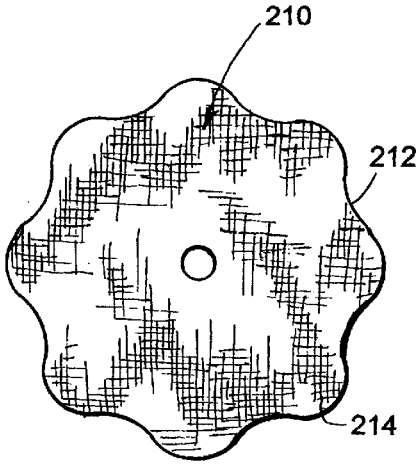
FIG. 4 is a plan view on a reduced scale similar to FIG. 3 but showing a further modification or variation of the invention.

The basic shape of the pad 10 illustrated in FIGS. 1 and 2 of the attached drawings represents what is currently deemed to be the most preferred such shape, but other generally similar or analogous peripheral undulations or reliefs will also provide varying degrees of improved results and the particular degree and size of curvature or other such undulation will also have a direct bearing on the resulting effect. FIGS. 3 and 4 illustrate other pads 110, 210 featuring other such edge configurations which employ the general principles of the invention, the FIG. 3 shape being similar to that of FIG. 1 but having deeper recesses on reliefs 112 around the edge to in effect form projections 114 which comprise larger circular segments than the analogous projection 14 of FIG. 1. These segments need not necessarily be defined by edges of entirely or even partially circular shape in an exact geometric sense, however, so long as they employ the concept involved. FIG. 4 shows a wavy, undulating edge shape 212, 214 which may also provide advantages in some cases.

Other such edge undulation shapes may comprise a series of straight-edged rectangular cutouts around the periphery of the disc which give it a toothed cog-like shape, and still other relief configurations (also not specifically illustrated in the drawings) may include either curved or straight angular relief edges, analogous to saw-tooth shapes. The depth (radial extent) of any of these recesses may vary to a considerable degree depending on the conditions encountered and results desired. An opposing consideration is the fact that such more rectilinear edges may be more likely to snag against obstructions or vertically projecting portions of the floor, and this may abrade or erode the leading edges or even produce tearing of the pad at these locations. Further, the actual length of the edge surface between recesses or relieved areas of comparable extent will be greater if the recesses have a curved shape rather than a rectilinear one.

For these reasons, a semi-circular edge recess 12 or projection 14 edge shape such as that shown in FIG. 1 is preferred, and the specific such shape presently regarded as the best has recesses or reliefs which extend inwardly from the outermost edge (defining the nominal or maximal diameter) a distance of approximately ten percent of the nominal pad radius. Nonetheless, as indicated above, various such particular and differing shapes and sizes may produce desirable results under differing circumstances, and all such variations may be considered to be "edge undulations" or "projections" as those terms are used herein.

The advantages and improved performance of the configurations just described have been amply demonstrated by actual performance tests. Improvement in both cleaning and polishing results, since the recessed edges not only follow surface recesses or depressions in the floor a great deal better than conventional circular pad shapes, but they also relieve the pressure on raised "high spots," and thus produce considerably less burning on these spots. Further, the total circumference of the regularly recessed pad in accordance with the invention clearly provides more perimetral edge contact with the floor during each revolution than is true of conventional circular pads. Of course, the basic improvement provided in accordance with the invention is obtained in any given machine configuration, i.e., regardless of the number of pads or pad size. The same is largely true for different cleaning and polishing compounds, and for different types of floors and floor finishes.

As will be understood, the foregoing disclosure and attached drawings are directed to various preferred embodiments of the invention for purposes of illustration; however, it should be understood that variations and modifications of these particular embodiments may well occur to those skilled in the art after considering their disclosure, and that all such variations etc., should be considered an integral part of the underlying invention, especially in regard to particular shapes and configurations of structural features. Furthermore, it should be understood that the drawings merely illustrate representative configurations, sizes, and shapes, which are subject to numerous particular implementations (in which regard, the center opening shown in the disc-like pads merely comprises a frequently employed mounting means which is not itself a part of the invention.

The above description is considered that of the preferred embodiments only. Modifications of the invention will occur to those skilled in the art and to those who make or use the invention. Therefore, it is understood that the embodiments shown in the drawings and described above are merely for illustrative purposes and not intended to limit the scope of the invention, which is defined by the following claims as interpreted according to the principles of patent law, including the doctrine of equivalents.

The invention claimed is:

1. A pad for a rotary-type floor cleaning and/or polishing machine, comprising:

a fibrous disk-shaped member having a plurality of arcuate projections extending about the outer perimetral edge thereof, each of the projections being of the same size and shape and being defined by a convex outer surface and further wherein the convex surfaces of each projection meets an adjacent projection such that they intersect at a point, the projections further defining a series of inwardly directed recesses therebetween; and wherein said recesses extend a distance in a radial direction corresponding to about 10% of the nominal radius defining the outermost circumference of the disk-shaped member.

* * * * *